US006416940B2

(12) United States Patent
Haye et al.

(10) Patent No.: US 6,416,940 B2
(45) Date of Patent: Jul. 9, 2002

(54) CALCIUM ION STABLE PHOTOGRAPHIC COLOR DEVELOPING COMPOSITION AND METHOD OF USE

(75) Inventors: Shirleyanne E. Haye, Rochester; Janet M. Huston, Webster; Charles M. Darmon, Spencerport; Charles S. Christ, Jr., Rochester; Paul A. Schwartz, Webster; William G. Henry, Caledonia, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/438,121

(22) Filed: Nov. 10, 1999

(51) Int. Cl.[7] ..... G03C 7/413
(52) U.S. Cl. ..... 430/466; 430/465; 430/491
(58) Field of Search ..... 430/465, 491, 430/466

(56) References Cited

U.S. PATENT DOCUMENTS

| | | | | | |
|---|---|---|---|---|---|
| 4,264,716 | A | * | 4/1981 | Vincent et al. | 430/380 |
| 4,546,068 | A | | 10/1985 | Kuse | 430/375 |
| 4,596,765 | A | | 6/1986 | Kurematsu et al. | 430/467 |
| 4,816,384 | A | * | 3/1989 | Fruge et al. | 430/465 |
| 4,876,174 | A | | 10/1989 | Ishikawa et al. | 430/380 |
| 4,892,804 | A | | 1/1990 | Vincent et al. | 430/380 |
| 4,900,651 | A | | 2/1990 | Ishikawa et al. | 430/380 |
| 4,975,357 | A | | 12/1990 | Buongiorne et al. | 430/433 |
| 5,034,308 | A | | 7/1991 | Abe et al. | 430/372 |
| 5,273,865 | A | | 12/1993 | Loiacono et al. | 430/490 |
| 5,354,646 | A | | 10/1994 | Kobayashi et al. | 430/372 |
| 5,660,974 | A | | 8/1997 | Marrese et al. | 430/490 |
| 6,017,687 | A | * | 1/2000 | Darmon et al. | 430/466 |

FOREIGN PATENT DOCUMENTS

| | | |
|---|---|---|
| EP | 0 204 372 | 10/1986 |
| EP | 0 793 141 A2 | 3/1997 |
| EP | 0 800 111 A1 | 8/1997 |

OTHER PUBLICATIONS

*Research Disclosure,* publication 13410, Jun., 1975.
*Research Disclosure,* publication 20405, Apr., 1981.
*Research Disclosure,* publication 18837, Dec., 1979.

* cited by examiner

*Primary Examiner*—Hoa Van Le
(74) *Attorney, Agent, or Firm*—J. Lanny Tucker

(57) ABSTRACT

A color developing composition is stable in the presence of calcium ion because of the presence of two specific types of polyphosphonic acid sequestering agents. The composition also comprises a color developing agent in free base form and an antioxidant for the color developing agent. The mixture of sequestering agents includes a polyaminopolyphosphonic acid and either a hydroxyalkylidenediphosphonic acid or morpholinomethanediphosphonic acid. The composition can be used to provide images in various color photographic silver halide materials.

15 Claims, No Drawings

CALCIUM ION STABLE PHOTOGRAPHIC COLOR DEVELOPING COMPOSITION AND METHOD OF USE

COPENDING APPLICATION

Reference is made to copending and commonly assigned U.S. Ser. No. 09/437,513 filed on even date herewith by Buongiorne and Haight and entitled "Calcium Ion Stable Photographic Color Developing Concentrate and Method of Manufacture".

FIELD OF THE INVENTION

The present invention relates to photographic color developing compositions that are stable to calcium ions, and to a method for their use. This invention is useful in the field of photography to provide color photographic images.

BACKGROUND OF THE INVENTION

The basic processes for obtaining useful color images from exposed color photographic silver halide materials include several steps of photochemical processing such as color development, silver bleaching, silver halide fixing and water washing or dye image stabilizing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al) describes conventional color developing compositions that have found considerable commercial success in the photographic industry. Other known color developing compositions are described in U.S. Pat. No. 4,876,174 (Ishikawa et al), U.S. Pat. No. 5,354,646 (Kobayashi et al) and U.S. Pat. No. 5,660,974 (Marrese et al).

It is common practice to add a "replenishing" solution to the color developing composition in the processing machine in order to replace photochemicals that are depleted during reaction or carried away by the processed materials. Such replenishment insures uniform development and maximum stability of the color developing agent.

Color developing compositions are commonly supplied in three or more "parts" (or solutions) that are mixed immediately before use. Multiple parts are often required in order to separate and preserve the chemical activity and solubility of components that may otherwise deteriorate or react with each other when they are stored together for long periods of time under alkaline conditions. For example, one part might include a color developing agent. Another part might contain agents to preserve the alkalinity of the mixed color developing composition. Still another part may include an optical brightener. Upon combination of all parts and water, a homogeneous color developing composition can usually be obtained for the working strength solution in the processing machine.

There is a desire in the industry to reduce the number of parts used to prepare color developing compositions, and particularly to prepare replenishing solutions. A wide range of compositions are described in the art or commercially available as "ready to use" solutions, concentrates or dry formulations. Liquid concentrates have only to be diluted with water to provide a working strength solution. Dry formulations need only be dissolved in water. For example, EP-A-0 793,141 (Chugai Photo) describes a two-part color developing composition that can be supplied in either solid or liquid form.

It is generally known that the concentrations of various photochemicals used in a photographic processing bath must lie within certain narrow limits in order to provide optimal performance. The most important solvent for such photoprocessing is water. Most inorganic salts can be readily dissolved in water while the organic photochemicals in such processing baths usually have suitable solubility in water at the desired operating concentrations.

However, water is both an asset and a major problem of ready-to-use and some concentrated photographic compositions because of its presence in high quantity. As a result, the costs of manufacturing, transport and storage of such compositions is steadily growing. Normally, the user of photochemical compositions has water available in which individual photochemicals could be mixed or diluted, but this is usually not practical for a number of reasons. The exact composition of the photochemicals is not readily determined by a common user and manufacturers are not likely to readily provide their formulations for such a purpose. Moreover, even if the formulations are known, mixing mistakes may result in poor photoprocessing results.

For these reasons, there is a trend in the photographic industry to provide photoprocessing compositions (including color developing compositions) in concentrated form so that the manufacturer and user need not pay for use, transport or storage of large volumes of water, and to enable use of smaller containers. Moreover, there has been a desire in the industry to provide compositions that can be used right out of their containers without the need for mixing various components (thereby reducing mixing errors), such as in what are known as "automatic replenishing" processors.

One concentrated form known in the art is a chemical paste or slurry, as described for example in EP-A-0 204,372 (Chemco) and EP-A-0 800,111 (Fuji Photo). These formulations have still other disadvantages, namely lack of homogeneity and slow dissolution rate of solid components.

Additional small volume, ready to use color developing compositions are described in U.S. Pat. No. 5,273,865 (Loiacono et al). These compositions are said to be free of bromides, hydroxylamines and benzyl alcohol, to include a polyol compound having 4 to 8 hydroxy groups, and to be useful for rapid access processing of photographic elements having high silver bromide emulsions only.

There was a need in the photographic industry for a single-part color developing composition that is homogeneous, concentrated and stable. Such an attractive photographic product is described and claimed in copending and commonly assigned U.S. Ser. No. 09/132,200 (filed Aug. 11, 1998 by Darmon et al). Such compositions include one or more metal ion sequestering agents, similar to those described in *Research Disclosure* publication 13410 (June 1975) and publication 20405 (April 1981). These metal ion sequestering agents are said to stabilize color developing compositions in the presence of heavy metal ions such as iron and copper ions. *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011).

However, it has been found that some color developing compositions, whether prepared from concentrates or not, are formulated using local water supplies that are high in calcium ion content. It is necessary to insure that color developing compositions are not adversely affected by the inordinate calcium ion content that may be evident in some locales. Thus, it is desired to insure that such compositions are stable from precipitates, especially calcium precipitates that may evident as scale or deposits on processing equipment.

SUMMARY OF THE INVENTION

This invention provides an advance in the art with a photographic color developing composition that, when in aqueous form, has a pH of from about 7 to about 13, and comprises:

a) at least 0.0005 mol/l of a color developing agent in free base form, b) at least 0.0005 mol/l of an antioxidant for the color developing agent, c) at least 0.0005 mol/l of a polyaminopolyphosphonic acid or a salt thereof having at least five phosphonic acid groups, and d) at least 0.00005 mol/l of a diphosphonic acid or a salt thereof that is either:

a hydroxyalklidene diphosphonic acid or a salt thereof, or morpholinomethanediphosphonic acid or a salt thereof.

Further, this invention includes a method for providing a color image comprising contacting a color photographic silver halide element with the photographic color developing composition described above. This color developing step in a photographic processing method can be followed by desilvering the color developed color photographic silver halide element, as well as any other useful photoprocessing steps known in the art.

The color developing composition of this invention offers a number of advantages over the color developing compositions currently available or known in the art. It is less susceptible to the formation of precipitates with calcium ion because of the presence of a combination of specific amounts to two specific types of polyphosphonic acids (or salts thereof). Each specific type of polyphosphonic acid alone fails to provide this advantage, and other combinations of known heavy metal ion sequestering agents also fail in this regard. Thus, only the specific materials described for this invention provide the necessary protection against the variable calcium ion concentration in water supplied throughout the world. In other words, the composition of the invention is stable upon storage and use despite the source of make-up water.

DETAILED DESCRIPTION OF THE INVENTION

The composition of this invention can be formulated in aqueous or solid form, and is preferably prepared as an aqueous composition by diluting a single-part concentrate at least four times. Preferred homogeneous, ready to use, single-part concentrates useful for this purpose are described and claimed in copending and commonly assigned U.S. Ser. No. 09/437,513 of Buongiorne et al (noted above). Alternatively, the composition of this invention can be prepared by mixing all of the desired components in any desired order at working strength concentrations. Still again, the compositions of this invention can be prepared by adding a diphosphonic acid (or a salt thereof), as described below, to a commercially available color developing composition (for example KODAK EKTACOLOR™ Prime SP Color Developer Replenisher) that already contains all other desirable components The composition of this invention contains one or more color developing agents generally in the form of a sulfate salt. Other components of the composition include one or more antioxidants for the color developing agent, a suitable number of alkali metal ions (in an at least stoichiometric proportion to the sulfate ions) provided by an alkali metal base, and optionally a photographically inactive water-miscible or water-soluble hydroxy-containing organic solvent. This solvent can be present in order to solubilize components if the composition is formulated from a concentrate.

More specifically, the color developing compositions of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure,* publication 38957, pages 592–639 (September 1996).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In order to protect the color developing agents from oxidation, one or more antioxidants are generally included in the color developing compositions. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones as described in copending and commonly assigned U.S. Ser. No. 09/123,976 (filed Jul. 29, 1998 by Qiao and McGarry). Mixtures of compounds from the same or different classes of antioxidants can also be used if desired.

Especially useful antioxidants are hydroxylamine derivatives as described for example, in U.S. Pat. No. 4,892,804 (Vincent et al), U.S. Pat. No. 4,876,174 (Ishikawa et al), U.S. Pat. No. 5,354,646 (Kobayashi et al) and U.S. Pat. No. 5,660,974 (Marrese et al), and U.S. Pat. No. 5,646,327 (Burns et al), the disclosures of which are all incorporated herein by reference with respect to antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

More preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al), incorporated herein by reference, as having the following Structure I:

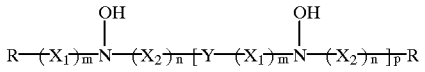

wherein R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is $—CR_2(OH)CHR_1—$ and $X_2$ is $—CHR_1CR_2(OH)—$ wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure I, m, n and p are independently 0 or 1. Preferably, each of m and n is 1, and p is 0.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

Many of the noted antioxidants (organic or inorganic) are either commercially available or prepared using starting materials and procedures described in the references noted above in describing hydroxylamines.

Buffering agents are generally present in the color developing compositions of this invention to provide or maintain desired alkaline pH of from about 7 to about 13, and preferably from about 8 to about 12. These buffering agents must be soluble in the organic solvent described herein and have a pKa of from about 9 to about 13. Such useful buffering agents include, but are not limited to carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred buffering agents. Mixtures of buffering agents can be used if desired.

In addition to buffering agents, pH can also be raised or lowered to a desired value using one or more acids or bases. It may be particularly desirable to raise the pH by adding a base, such as a hydroxide (for example sodium hydroxide or potassium hydroxide).

An optional but preferred component of the color developing compositions of this invention is a photographically inactive, water-miscible or water-soluble, straight-chain organic solvent that is capable of dissolving color developing agents in their free base forms. Such organic solvents can be used singly or in combination, and preferably each has a molecular weight of at least 50, and preferably at least 100, and generally 200 or less and preferably 150 or less. Such preferred solvents generally have from 2 to 10 carbon atoms (preferably from 2 to 6 carbon atoms, and more preferably from 4 to 6 carbon atoms), and can additionally contain at least two nitrogen or oxygen atoms, or at least one of each heteroatom. The organic solvents are substituted with at least one hydroxy functional group, and preferably at least two of such groups. They are straight-chain molecules, not cyclic molecules.

By "photographically inactive" is meant that the organic solvents provide no substantial positive or negative effect upon the color developing function of the concentrate.

Useful organic solvents include, but are not limited to, polyols including glycols (such as ethylene glycol, diethylene glycol and triethylene glycol), polyhydroxyamines (including polyalcoholamines), and alcohols (such as ethanol and benzyl alcohol). Glycols are preferred with ethylene glycol, diethylene glycol and triethylene glycol being most preferred. Of the alcohols, ethanol and benzyl alcohol are most preferred. The most preferred organic solvent is diethylene glycol.

An essential component of the color developing composition of this invention is a polyaminopolyphosphonic acid (or salt thereof) that has at least five phosphonic acid (or salt) groups (herein "First Sequestering Agent"). A mixture of such compounds can be used if desired. Suitable salts include ammonium and alkali metal ions salts.

Preferred compounds of this nature can be represented by the following Structure II:

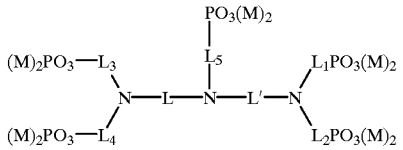

wherein L, L', $L_1$, $L_2$, $L_3$, $L_4$ and $L_5$ are independently substituted or unsubstituted divalent aliphatic linking groups, each independently having 1 to 4 carbon, oxygen, sulfur or nitrogen atoms in the linking group chain. Preferably, these substituted or unsubstituted divalent linking groups have 1 to 4 carbon atoms in the linking group chain (such as substituted or unsubstituted branched or linear alkylene groups). More preferably, the divalent linking groups are independently substituted or unsubstituted methylene or ethylene. Most preferably, L and L' are each substituted or unsubstituted ethylene (preferably unsubstituted), and each of the other linking groups is an unsubstituted methylene group. M is hydrogen or a monovalent cation (such as ammonium ion or an alkali metal salt).

The noted divalent groups can be substituted with any substituent that does not interfere with the desired performance of the sequestering agent, or with the photochemical properties of the color developing compositions. Such substituents include, but are not limited to, hydroxy, sulfo, carboxy, halo, lower alkoxy (1 to 3 carbon atoms) or amino.

Mixtures of these First Sequestering Agents can be used if desired. A particularly useful First Sequestering Agent is diethylenetriaminepentamethylene-phosphosphonic acid or an alkali metal salt thereof (available as DEQUEST™ 2066 from Solutia Co.).

Still another essential component of the color developing composition of this invention is a diphosphonic acid (or salt thereof), herein referred to as "Second Sequestering Agent".

One useful class of Second Sequestering Agents includes hydroxyalkylidene diphosphonic acids (or salts thereof). Mixtures of such compounds can be used if desired. Useful salts include the ammonium and alkali metal ion salts.

Preferred hydroxyalkylidene diphosphonic acids (or salts thereof) can be represented by the following Structure III:

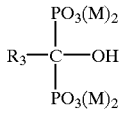

wherein $R_3$ is a substituted or unsubstituted alkyl group having 1 to 5 carbon atoms (methyl, methoxymethyl, ethyl, isopropyl, n-butyl, t-butyl and n-pentyl)and M is hydrogen or a monovalent cation (such as ammonium or alkali metal ions). Preferably, $R_3$ is methyl or ethyl, and most preferably, it is ethyl.

Representative Second Sequestering Agents of this class include, but are not limited to, 1-hydroxyethylidene-1,1-diphosphonic acid, 1-hydroxy-n-propylidene-1,1-diphosphonic acid, 1-hydroxy-2,2-dimethylpropylidene-1,1-diphosphonic acid and others that would be readily apparent to one skilled in the art (and alkali metal and ammonium salts thereof). The first compound is most preferred and is available as DEQUEST™ 2010. Its tetrasodium salt is available as DEQUEST™ 2016D. Both materials are available from Solutia Co.

Another useful Second Sequestering Agent is morpholinomethanediphosphonic acid or a salt thereof.

A mixture of one or more compounds from each class of Second Sequestering Agents can be used in the color developing composition of this invention if desired, in any desirable proportions. The total concentration of Second Sequestering Agents is described in TABLE I below.

It is also possible to include other metal ion sequestering agents (for example, for iron, copper or manganese ion sequestration) in the color developing composition as long as the other conditions of the invention are met.

The compositions of this invention can also include one or more of a variety of other addenda that are commonly used in photographic color developing compositions, including alkali metal halides (such as potassium chloride, potassium bromide, sodium bromide and sodium iodide), auxiliary co-developing agents (such as phenidone type compounds particularly for black and white developing compositions), antifoggants, development accelerators, optical brighteners (such as triazinylstilbene compounds), wetting agents, fragrances, stain reducing agents, surfactants, defoaming agents, and water-soluble or water-dispersible color couplers, as would be readily understood by one skilled in the art [see for example, *Research Disclosure* publications noted above]. The amounts of such additives are well known in the art also. Representative color developing compositions of this invention are described below in the examples.

It is preferred that no lithium or magnesium ions are purposely added to the color developing compositions of this invention. Depending upon the concentrations of such ions in water used to make up processing solutions, or carried over from previous processing baths, the total concentration (that is, the sum) of these ions remains preferably very low, that is less than 0.0001 mol/l in the compositions, and preferably a total of less than 0.00001 mol/l.

The following TABLE I lists the general and preferred amounts of the essential and some optional components of the color developing compositions of this invention. The preferred ranges are listed in parentheses ( ), and all of the ranges are considered to be approximate or "about" in the upper and lower end points. During color development, the actual concentrations can vary depending upon extracted chemicals in the composition, replenishment rates, water losses due to evaporation and carryover from any preceding processing bath and carryover to the next processing bath. The amounts are total concentrations for the various components that can be present in mixtures.

TABLE I

| COMPONENT | CONCENTRATIONS |
|---|---|
| Color developing agent(s) | 0.0005–0.25 mol/l (0.005–0.03 mol/l) |
| Antioxidant(s) | 0.0005–0.25 mol/l (0.005–0.05 mol/l) |
| Buffering agent(s) | 0.002–0.8 mol/l (0.01–0.5 mol/l) |
| First Sequestering Agent(s) | 0.0005–0.05 mol/l (0.001–0.01 mol/l) |
| Second Sequestering Agent(s) | 0.00005–0.001 mol/l (0.0001–0.0008 mol/l) |

The color developing compositions of this invention have utility to provide color development in an imagewise exposed color photographic silver halide element comprising a support and one or more silver halide emulsion layers containing an imagewise distribution of developable silver halide emulsion grains. A wide variety of types of photographic elements (both color negative and color reversal films and papers, and color motion picture films and prints) containing various types of emulsions can be processed using the present invention, the types of elements being well known in the art (see *Research Disclosure* publication 38957 noted above). In particular, the invention can be used to process color photographic papers of all types of emulsions including so-called "high chloride" and "low chloride" type emulsions, and so-called tabular grain emulsions as well. The color developing composition can also be used in processing of color reversal and color negative films.

The present invention is particularly useful to process high chloride (greater than 70 mole % chloride and preferably greater than 90 mole % chloride, based on total silver) emulsions in color photographic papers. Such color photographic papers can have any useful amount of silver coated in the one or more emulsions layers, and in some embodiments, low silver (that is, less than about 0.8 g silver/$m^2$) elements are processed with the present invention.

The layers of the photographic elements can have any useful binder material or vehicle as it known in the art, including various gelatins and other colloidal materials.

Representative commercial color papers that are useful in the practice of this invention include, but are not limited to, KODAK EKTACOLOR EDGE V, VII and VIII Color Papers (Eastman Kodak Company), KODAK ROYAL VII Color Papers (Eastman Kodak Company), KODAK PORTRA III, IIIM Color Papers (Eastman Kodak Company), KODAK SUPRA III and IIIM Color Papers (Eastman Kodak Company), KODAK ULTRA III Color Papers (Eastman Kodak Company), FUJI SUPER Color Papers (Fuji Photo Co., FA5, FA7 and FA9), FUJI CRYSTAL ARCHIVE and Type C Color Papers (Fuji Photo Co.), KONICA COLOR QA Color Papers (Konica, Type QA6E and QA7), and AGFA TYPE II and PRESTIGE Color Papers (AGFA). The compositions and constructions of such commercial color photographic elements would be readily determined by one skilled in the art. KODAK DURATRANS, KODAK DURACLEAR, KODAK EKTAMAX RAL and KODAK DURAFLEX photographic materials, and KODAK Digital Paper Type 2976 can also be processed using the present invention. The compositions and constructions of such commercial color photographic elements could be readily determined by one skilled in the art.

Color development of an imagewise exposed photographic silver halide element is carried out by contacting the element with a color developing composition of this invention under suitable time and temperature conditions, in suitable processing equipment, to produce the desired developed color image. Additional processing steps can then be carried out using conventional procedures, including but not limited to, one or more color development stop, bleaching, fixing, bleach/fixing, washing (or rinsing), stabilizing and drying steps, in any particular desired order as would be known in the art. Useful processing steps, conditions and materials useful therefor are well known for the various processing protocols including the conventional Process C-41 processing of color negative films, Process RA-4 for processing color papers and Process E-6 for processing color reversal films (see for example, *Research Disclosure* publication 38957 noted above).

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

More details of the element structure and components, and suitable methods of processing various types of elements are described in *Research Disclosure* publication 38957 noted above. Included within such teachings in the art is the use of various classes of cyan, yellow and magenta color couplers that can be used with the present invention (including pyrazolone and pyrazolotriazole type magenta dye forming couplers). In addition, the present invention can be used to process color photographic papers having pigmented resin-coated paper supports which are prepared with the usual internal and external sizing agents (including alkylketene dimers and higher fatty acids), strengthening agents and other known paper additives and coatings.

The color developing composition of this invention can also be used in what are known as redox amplification processes, as described for example, in U.S. Pat. No. 5,723,268 (Fyson) and U.S. Pat. No. 5,702,873 (Twist).

Processing according to the present invention can be carried out using conventional deep tanks holding processing solutions. Alternatively, it can be carried out using what is known in the art as "low volume thin tank" processing systems, or LVTT, which have either a rack and tank or automatic tray design. These processors are sometimes included in what are known as "minilabs." Such processing methods and equipment are described, for example, in U.S. Pat. No. 5,436,118 (Carli et al) and publications noted therein.

Color development is generally followed by desilvering using separate bleaching and fixing steps, or a combined bleach/fixing step using suitable silver bleaching and fixing agents. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure* publication 38957 noted above, U.S. Pat. No. 5,582,958 (Buchanan et al) and U.S. Pat. No. 5,753,423 (Buongiorne et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al). Useful fixing agents are also well known in the art and include various thiosulfates and thiocyanates or mixtures thereof.

The processing time and temperature used for each processing step of the present invention are generally those conventionally used in the art. For example, color development is generally carried out at a temperature of from about 20 to about 60° C. The overall color development time can be up to 40 minutes, and preferably from about 75 to about 450 seconds. The shorter overall color development times are desired for processing color photographic papers.

The color developing composition of this invention can be used as a working strength solution or replenisher.

The following examples are provided to illustrate the practice of this invention and not to limit it in any way. Unless otherwise indicated, percentages are by weight.

EXAMPLE 1

Preparation, Evaluation and Comparisons of Color Developing Compositions

The following methods were used to identify color developing compositions that inhibit calcium deposit formation:

1) Turbidimetric titration was used to estimate the amount of calcium ion that is controlled by the sequestering agent additive (TABLE III below) proposed for the color developing composition. The resulting compositions were titrated to a permanent turbidity using 0.25–0.5 mol/l calcium chloride solutions at room temperature. The results shown in TABLE III below indicate that all of the sequestering agent additives (except for ethylenediaminetetraacetic acid (EDDA) and tartaric acid) provided some improvement in reduced calcium complexation over the standard commercial EKTACOLOR™ Prime SP Developer Replenisher (see TABLE II below) that contains DEQUEST™ 2066 sequestering agent ("D2066") as the sole calcium ion sequestering agent. However, the improvements were more pronounced in the presence of excess "D2066", 2.5 mmol/l of 1-hydroxyethylidene-1,1-diphosphonic acid ("D2010"), and 2 mmol/l of morpholinomethanediphosphonic acid ("MMDP"). Although the turbidimetric titration is useful for comparing the complexation of the sequestering agents in the color developing composition, it may not adequately predict the likely occurrence of scale formation. For example, while the commercially available EKTACOLOR™ Prime SP Color Developer Replenisher (containing 4 ml of "D2066") became turbid in the presence of 200 ppm of calcium ions, calcium carbonate scale was observed in the presence of 140 ppm calcium ions.

2) To determine the kinetic behavior of the color developing composition with time, standing solutions of commercially available EKTACOLOR™ Prime SP Developer Replenisher with polyphosphonic acid sequestering additives and 140 to 200 ppm calcium ions as $CaCl_2.2H_2O$ in contact with samples of commercially available Tygon tubing and polycarbonate plates were monitored for precipitate or scale at room temperature and at 38° C. Solutions were also measured from time to time for calcium ion, and the results for 200 ppm calcium ions are shown in Table IV below. As predicted by the turbidimetric titration, DEQUEST™ 2054 ("D2054") and MAYOQUEST™ 2100 ("M2100") sequestering agents quickly produced calcium carbonate scale on the tubing similar to that seen with the commercial EKTACOLOR™ Prime SP Developer Replenisher. Excess "D2066" sequestering agent delayed scale formation for six weeks, while "D2010" and "MMDP" inhibited scale formation after standing beyond six weeks. However, above 1.25 mmol/l of "D2010", calcium phosphonate sludge was observed within two weeks of standing. Below 1.25 mmol/l of "D2010", no precipitate was visible until at 0.1 mmol/l of "D2010" when scale again appeared after eight weeks of standing. No scale was observed with 2.0 to 0.2 mmol/l of "MMDP". At 140 ppm calcium ions, a similar trend (although with a longer delay before scale was observed) was seen for the sequestering agents.

Calcium ion values of the commercially available EKTACOLOR™ Prime SP Developer Replenisher with and without 0.2 mmol/l of "D2010" and in the presence of 200 ppm calcium ions after 76 days standing are recorded in TABLE V below. The experimental color developing composition containing 0.2 mmol/l of"D2010" exhibited no calcium carbonate scale and complexed all of the calcium ions, while the EKTACOLOR™ Prime SP Developer Replenisher exhibited scale at lower calcium ion concentration.

3) Experimental color developing compositions formed by adding "D2010" and excess calcium ions to EKTACOLOR™ Prime SP Developer Replenisher were seeded with Tygon tubing covered with a small amount of $CaCO_3$ scale. The compositions were aged in clear bottles at ambient temperature and 38° C. The results are show in TABLE V below. The color developing compositions containing no excess calcium ions dissolved the calcium scale and produced an increase in the calcium ion level. For the standard EKTACOLOR™ Prime SP Developer, an increase in the scale was observed. However, with the color developing compositions containing excess "D2066" and "D2010", no scale formation was observed even after 26 days of standing. These results indicate that the compositions have little or no calcium deposit formation even when the processing tank already contained residual calcium scale or precipitates.

These examples demonstrate that the addition of about 1.0–0.2 mmol/l of "D2010" to the EKTACOLOR™ Prime SP Developer Replenisher is especially advantageous for controlling scale formation. Thus, the color developing composition of this invention includes a mixture of "D2010" and "D2066". The most recommended amount of the diphosphonic acid "D2010" is 0.02 mmol/l (0.05ml/1). A preferred alternative diphosphonic acid is "MMDP" 10 at 0.2–2 mmol/l.

TABLE II

| COMPONENT | STANDARD | INVENTION |
|---|---|---|
| Sodium hydroxide (50% solution) | 3.99 g | 3.99 g |
| N,N-Diethylhydroxylamine (85% solution) | 5.4 g | 5.4 g |
| Kodak Color Developing Agent (KODAK CD-3) | 6.8 g | 6.8 g |
| Diethylene glycol | 79.4 g | 79.4 g |
| DEQUEST ™ 2010 ("D2010") 1-Hydroxyethylidene-1,1-diphosphonic acid (60% w/w) | 0 | 0.072 g |

TABLE II-continued

| COMPONENT | STANDARD | INVENTION |
|---|---|---|
| Potassium carbonate (47% solution) | 45.9 g | 45.9 g |
| Potassium bicarbonate | 1.9 | 1.9 g |
| Potassium bromide | 0.025 g | 0.025 g |
| Triazinylstilbene optical brightener (BLANKOPHOR REU 180 from Bayer) | 1.11 g | 1.11 g |
| Triethanolamine (85% solution) | 2.99 g | 2.99 g |
| DEQUEST ™ 2066 ("D2066") diethylenetriaminepentaphosphonic acid, sodium salt | 5.2 g | 5.2 g |
| Fragrance | 0.24 g | 0.24 g |
| Water to make | 1 liter | 1 liter |
| pH | 10.85 | 10.86 |

TABLE III

| SEQUESTERING AGENT ADDITIVE | LEVEL (mmol/l) | $Ca^{2+}$ (ppm) |
|---|---|---|
| None (standard composition) | 2 | 205 |
| Standard composition with excess "D2066" | 1 | 280 |
| VERSENATE PS[a] | 1 ml/l | 260 |
| D2054[b] | 2 | 220 |
| "AC-4"* | 2 | 220 |
| "D2010" | 2.52 | 360 |
| MMDP** | 2 | 340 |
| MAYOQUEST ™ 2100*** | 2 | 240 |
| IRGAFORM 3000 (50%) | 1 ml/l | 220 |
| NTA[c] | 2 | 245 |
| L-Tartaric acid | 2 | 200 |
| EDDA[d] | 2 | 195 |

[a]28% "D2066", 8% polyacrylic acid by Dow
[b]Hexamethylenediaminetetra(methylenephosphonic acid) hexapotassium salt
[c]Nitrilotriacetic acid
[d]Ethylenediaminediacetic acid
*Aminotri(methylenephosphonic acid), pentasodium salt
**Morpholinomethanediphosphonic acid
***2-Phosphonobutane-1,2,4-tricarboxylic acid

TABLE IV

| SEQUESTERING AGENT ADDITIVE | Level (mmol/l) | 2 weeks | 4 weeks | 6 weeks | 8 weeks |
|---|---|---|---|---|---|
| None- Standard composition | 0 | s | s | s | s |
| Standard composition with excess "D2066" | 1 | ns, np | ns, np | ns, np | s |
| VERSENATE PS | 1 ml/l | ns, np | ns, np | ns, np | s |
| "D2054" | 2 | s | s | s | s |
| "AC-4" | 2 | ns, np | ns, np | ns, np | s |
| "D2010" (Invention) | 2.50–1.25 | p, ns | p, ns | p, ns | p, ns |
| "D2010" (Invention) | 0.63–0.21 | np, ns | np, ns | np, ns | np, ns |
| "D2010" (Invention) | 0.104–0.04 | np, ns | np, ns | np, ns | s |
| "MMDP" (Invention) | 2–1.25 | ns, np | ns, np | ns, np | ns, np |
| "MMDP" (Invention) | 0.6–0.2 | ns, np | ns, np | ns, np | ns, np |
| MAYOQUEST ™ 2100 | 2 | ns, np | s | s | s |

"p" refers to the presence of calcium phosphonate precipitate,
"s" refers to the presence of calcium carbonate scale on the tubing sample,
"np" refers to no precipitate,
"ns" refers to no scale.

TABLE V

| COLOR DEVELOPING COMPOSITION | OBSERVATIONS | $Ca^{+2}$ ADDED* (ppm) | $Ca^{+2}$ (ppm)* 76 days standing (Unfiltered) | $Ca^{+2}$ (ppm)* 76 days standing (Filtered)** |
|---|---|---|---|---|
| EKTACOLOR ™ Prime SP Developer Replenisher | s | 140 | 83 | 100 |
| EKTACOLOR ™ Prime SP Developer Replenisher | s | 170 | 95 | 102 |
| EKTACOLOR ™ Prime SP Developer Replenisher | s | 200 | 86 | 97 |
| EKTACOLOR ™ Prime SP Developer Replenisher & "D2010" (0.2 mmol/l, Invention) | np, ns | 140 | 142 | 142 |
| EKTACOLOR ™ Prime SP Developer Replenisher & "D2010" (0.2 mmol/l, Invention) | np, ns | 170 | 166 | 168 |
| EKTACOLOR ™ Prime SP Developer Replenisher & "D2010" (0.2 mmol/l, Invention) | np, ns | 200 | 193 | 194 |

| SEEDING EXPERIMENT | | | 1 day | 26 days standing (Unfiltered) | 26 days standing (Filtered)** |
|---|---|---|---|---|---|
| EKTACOLOR ™ Prime SP Developer Replenisher | dissolution | 0 | 14 | 29 | 29 |
| EKTACOLOR ™ Prime SP Developer Replenisher | no change | 140 | 130 | 140 | 145 |
| EKTACOLOR ™ Prime SP Developer Replenisher | s | 200 | 170 | 126 | 129 |
| EKTACOLOR ™ Prime SP Developer Replenisher & "D2010" (0.2 mmol/l, Invention) | dissolution | 0 | 17 | 37 | 43 |
| EKTACOLOR ™ Prime SP Developer Replenisher & "D2010" (0.2 mmol/l, Invention) | no change | 140 | 120 | 143 | 149 |
| EKTACOLOR ™ Prime SP Developer Replenisher & "D2010" (0.2 mmol/l, Invention) | no change | 200 | 190 | 204 | 202 |
| EKTACOLOR ™ Prime SP Developer Replenisher & "D2066" (1 mmol/l) | dissolution | 0 | 19 | 46 | 43 |
| EKTACOLOR ™ Prime SP Developer Replenisher & "D2066" (1 mmol/l) | no change | 170 | 130 | 157 | 159 |
| EKTACOLOR ™ Prime SP Developer Replenisher & "D2066" (1 mmol/l) | no change | 200 | 180 | 202 | 201 |

p refers to calcium phosphonate precipitate,
s refers to calcium carbonate scale on tubing samples,
np refers to no precipitate,
ns refers to no scale.
*Determined by atomic emission spectroscopy
**Solutions were filtered through Whatman AutoDial with 0.45-micron nylon membrane

EXAMPLE 2

Processing of Color Paper

A processing tank solution was prepared by firstly adding KODAK EKTACOLOR™ Prime SP Developer Replenisher to eight liters of water that contained DEQUEST™ 2010 sequestering agent at 0.05 ml/l (final concentration of 0.0002 mol/l), and further diluted to 10 liters. To 1200 ml of this solution was added 80 ml of commercially available KODAK EKTACOLOR Developer Starter, and the resulting solution was diluted to 2 liters.

This resulting starting tank processing solution was used in a conventional processor to color develop imagewise exposed samples of commercially available KODAK EKTACOLOR EDGE V Color Paper using the conventional Process RA protocol noted as follows.

| | | |
|---|---|---|
| Color Development | 38° C. | 45 seconds |
| Bleach/fixing | 35° C. | 45 seconds |
| Washing/Stabilizing | 35° C. | 90 seconds |

Bleach/fixing was carried out using commercially available KODAK EKTACOLOR Prime Bleach-Fix and the washing step was carried out using KODAK EKTACOLOR Prime Stabilizer. Acceptable color images were obtained as shown in the following TABLE VI showing various sensitometric data for the red ("R"), green ("G") and blue ("B") color records in two replicates. The data were measured using known procedures.

TABLE VI

| Invention Color Developing Composition | Dye Stain R, G, B | Low Density R, G, B | High Density - Low Density R, G, B | Black Patch R, G, B |
|---|---|---|---|---|
| Replicate 1 | 0.09, 0.09, 0.10 | 0.89, 0.86, 0.83 | 0.87, 0.85, 0.88 | 2.26, 2.24, 2.20 |
| Deviation from Aim | 0, 0.02, 0.02 | 0.07, 0.08, 0.08 | 0.02, 0.03, 0.02 | 0.09, 0.14, 0.09 |
| Replicate 2 | 0.10, 0.09, 0.10 | 0.89, 0.86, 083 | 0.88, 0.85, 0.88, | 2.25, 2.23, 2.19 |
| Deviation from Aim | 0.01, 0.02, 0.02 | 0.07, 0.08, 0.08 | 0.03, 0.03, 0.02 | 0.08, 0.13, 0.08 |

The invention has been described in detail with particular reference to preferred embodiments thereof, but it will be understood that variations and modifications can be effected within the spirit and scope of the invention.

We claim:

1. An aqueous photographic color developing composition that has a pH of from about 7 to about 13 and comprises:

a) at least 0.0005 mol/l of a color developing agent, b) at least 0.0005 mol/l of an antioxidant for said color developing agent, c) at least 0.0005 mol/l of a polyaminopolyphosphonic acid or salt thereof that has at least five phosphonic acid groups, and d) at least 0.00005 mol/l of a diphosphonic acid or salt thereof that is a hydroxyalkylidene diphosphonic acid or a salt thereof, or morpholinomethanedisphosphonic acid or a salt thereof.

2. The color developing composition of claim 1 having a pH of from about 8 to about 12.

3. The color developing composition of claim 1 wherein said antioxidant is a hydroxylamine derivative having a solubilizing group.

4. The color developing composition of claim 3 wherein said antioxidant is represented by the structure I:

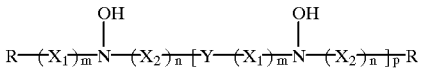

wherein R is hydrogen, an alkyl group, a hydroxyalkyl group, a cycloalkyl group or an aryl group, $R_1$ and $R_2$ are independently hydrogen, hydroxy, an alkyl group, or a hydroxyalkyl group, or $R_1$ and $R_2$ together represent the carbon atoms necessary to complete a 5- to 8-membered carbocyclic ring structure, $X_1$ is —$CR_2(OH)CHR_1$—, $X_2$ is —$CHR_1CR_2(OH)$—, and m, n and p are independently 0 or 1.

5. The color developing composition of claim 1 further comprising a water-miscible or water-soluble hydroxy-substituted, straight-chain organic solvent that has a molecular weight of from about 50 to about 200.

6. The color developing composition of claim 5 further comprising a buffering agent that is soluble in said organic solvent.

7. The color developing composition of claim 6 wherein said buffering agent is a carbonate.

8. The color developing composition of claim 1 wherein said polyaminopolyphosphonic acid or a salt thereof is represented by the Structure II:

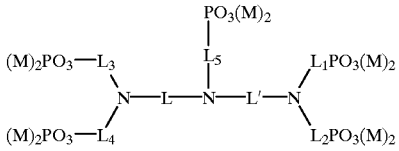

wherein L, L', $L_1$, $L_2$, $L_3$, $L_4$ and $L_5$ are independently divalent aliphatic linking groups independently having from 1 to 4 carbon, oxygen, sulfur or nitrogen atoms in the linking group chain, and M is hydrogen or a monovalent cation.

9. The color developing composition of claim 8 wherein said divalent aliphatic linking groups independently have from 1 to 4 carbon atoms in the linking group chain.

10. The color developing composition of claim 9 wherein said polyaminopolyphosphonic acid or salt thereof is diethylenetriaminepentamethylenephosphonic acid or a salt thereof.

11. The color developing composition of claim 1 wherein said diphosphonic acid or salt thereof is a hydroxyalkylidene diphosphonic acid or a salt thereof represented by Structure III:

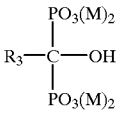

wherein $R_3$ is an alkyl group of 1 to 5 carbon atoms, and M is hydrogen or a monovalent cation.

12. The color developing composition of claim 11 wherein $R_3$ is methyl or ethyl and M is hydrogen or an alkali metal ion.

13. The color developing composition of claim 1 comprising no purposely added lithium magnesium ions.

14. The aqueous photographic color developing composition of claim 1 wherein said color developing agent is present in free base form.

15. An aqueous color developing composition having a pH of from about 8 to about 12 and comprising:

a) from about 0.005 to about 0.03 mol/l of a color developing agent in free base form, b) from about 0.005 to about 0.05 mol/l of a hydroxylamine derivative antioxidant for said color developing agent, c) a water-miscible or water-soluble hydroxy-substituted, straight-chain organic solvent that has a molecular weight of from about 100 to about 200, d) a carbonate buffering agent, e) from about 0.001 to about 0.01 mol/l of diethylenetriaminepentamethylenephosphonic acid or a salt thereof, and f) from about 0.0001 to about 0.0008 mol/l of a hydroxyethylidene-1,1-disphosphonic acid or a salt thereof, or morpholinomethanedisphosphonic acid or a salt thereof.

* * * * *